US012727721B2

(12) United States Patent
Baldini

(10) Patent No.: US 12,727,721 B2
(45) Date of Patent: Sep. 8, 2026

(54) CORNER SHELF ASSEMBLY

(71) Applicant: Frank Baldini, Old Bridge, NJ (US)

(72) Inventor: Frank Baldini, Old Bridge, NJ (US)

(73) Assignee: Frank Baldini

( * ) Notice: Subject to any disclaimer, the term of this patent is extended or adjusted under 35 U.S.C. 154(b) by 0 days.

(21) Appl. No.: 18/958,495

(22) Filed: Nov. 25, 2024

(65) Prior Publication Data

US 2026/0144411 A1 May 28, 2026

(51) Int. Cl.

| | |
|---|---|
| ***A47K 3/28*** | (2006.01) |
| ***A47B 96/02*** | (2006.01) |
| ***A47B 96/06*** | (2006.01) |
| *A47F 5/00* | (2006.01) |
| *A47F 5/01* | (2006.01) |
| *A47F 5/08* | (2006.01) |

(52) U.S. Cl.

CPC ..... *A47K 3/281* (2013.01); *A47B 96/022* (2013.01); *A47B 96/06* (2013.01); *A47F 5/0031* (2013.01); *A47F 5/01* (2013.01); *A47F 5/08* (2013.01)

(58) Field of Classification Search

CPC ..... A47B 96/06; A47B 96/022; A47B 47/00; A47B 47/0033; A47B 47/02; A47B 47/021; A47B 47/024; A47B 47/027; A47B 47/04; A47B 57/00; A47B 57/06; A47B 57/30; A47K 3/281; D06F 57/12; A47F 5/00; A47F 5/08; A47F 5/0018; A47F 5/0031; A47F 5/0081; A47F 5/01; A47F 5/0846

See application file for complete search history.

(56) References Cited

U.S. PATENT DOCUMENTS

| | | | | | |
|---|---|---|---|---|---|
| 2,657,811 | A | * | 11/1953 | Isler | A47B 5/02 312/238 |
| 2,700,475 | A | * | 1/1955 | Stalter | A47B 96/022 248/248 |
| 4,233,911 | A | | 11/1980 | Vignale | |
| D274,201 | S | * | 6/1984 | Aaron | D6/525 |
| 4,456,125 | A | * | 6/1984 | Chap | B65D 7/14 206/513 |

(Continued)

FOREIGN PATENT DOCUMENTS

KR 20170100766 A * 9/2017 ..... A47B 96/022

*Primary Examiner* — Devin K Barnett

(74) *Attorney, Agent, or Firm* — Jordan Sworen; Daniel Enea; Argus Intellectual Enterprise, LLC

(57) ABSTRACT

A corner shelf assembly is provided. The shelf assembly includes a bracket that can be mounted over an integrated corner shelf of a preexisting shower. The bracket includes a pair of parallel bars forming a ninety-degree angle at their midpoint, creating a gap capable of receiving the integrated shelf. This arrangement allows the assembly to be suspended stably, with support members extending adjacent to the shower walls to form a corner structure. One or more auxiliary shelves are arranged above or below the bracket to provide additional storage within the shower space. The assembly permits adjustable positioning of these shelves in terms of size and height to suit various shower items. The parallel bars are constructed to expose a significant portion of the integrated corner shelf, enabling its continued use while enhancing storage capacity. The design maximizes space utilization by fitting snugly into ninety-degree corner areas.

17 Claims, 4 Drawing Sheets

(56) References Cited

U.S. PATENT DOCUMENTS

D304,398 S * 11/1989 Goetz ..... D6/676.1
4,886,236 A * 12/1989 Randall ..... A47B 96/022 211/90.01
D313,720 S * 1/1991 Sorenson ..... D6/562
5,014,860 A * 5/1991 Emery ..... A47K 5/02 248/206.3
D329,158 S * 9/1992 Tuzi ..... D6/525
5,169,010 A 12/1992 Fortner
D351,751 S * 10/1994 Brightbill ..... D6/525
5,588,543 A * 12/1996 Finger ..... A47F 5/083 211/90.01
D382,751 S * 8/1997 Andrus ..... D6/525
D388,992 S * 1/1998 Weisburn ..... D6/562
5,724,894 A * 3/1998 Knorovsky ..... A47K 3/281 108/42
D408,185 S * 4/1999 Hofman ..... D6/525
D409,868 S * 5/1999 France ..... D6/562
5,983,805 A * 11/1999 Waluda ..... A47B 96/022 108/42
D421,867 S * 3/2000 Carville ..... D6/525
6,234,330 B1 * 5/2001 Gray ..... A47F 5/0838 211/106
D475,561 S * 6/2003 Suero, Jr. ..... D6/525
D513,142 S * 12/2005 Suero, Jr. ..... D6/525
D514,847 S * 2/2006 Peller ..... D6/676.2
D620,293 S * 7/2010 Guindi ..... D6/562
D632,514 S * 2/2011 Didehvar ..... A47K 3/281 D6/525
7,959,020 B2 * 6/2011 Rosen ..... D06F 79/02 248/302
D651,838 S * 1/2012 Yang ..... D6/525
D653,068 S * 1/2012 Klein ..... D6/562
D713,181 S * 9/2014 Cohen ..... D6/676.1
D716,083 S * 10/2014 Hsu ..... D6/678.4
10,034,587 B1 * 7/2018 Elliot ..... A47K 3/281
D907,414 S * 1/2021 Li ..... D6/676.1
D950,988 S * 5/2022 Chen ..... D6/676.1
D954,466 S * 6/2022 Tan ..... D6/562
D1,010,352 S * 1/2024 Amozoc ..... D6/562
D1,032,257 S * 6/2024 Ye ..... D6/676.1
12,016,460 B1 * 6/2024 Whitt ..... A47K 10/32
D1,051,645 S * 11/2024 Wei ..... D6/676.1
12,336,630 B1 * 6/2025 Majors ..... A47B 87/0246
2003/0029821 A1 2/2003 Shone
2003/0173321 A1 * 9/2003 Craft ..... A47B 49/006 211/144
2008/0308512 A1 12/2008 Knepfle
2009/0121103 A1 * 5/2009 Wiese ..... A47B 49/00 248/220.1
2013/0228541 A1 * 9/2013 O'Hara ..... A47B 96/022 52/741.1
2013/0313212 A1 * 11/2013 Lindo ..... A47B 57/265 211/119.011
2014/0197119 A1 * 7/2014 Stenhouse ..... A47B 96/022 211/90.01
2016/0066751 A1 3/2016 Hinson
2016/0095437 A1 * 4/2016 Crandall ..... A47B 96/021 211/90.01
2017/0049237 A1 2/2017 Nocik, Jr.
2022/0386824 A1 12/2022 Bautista et al.

* cited by examiner

CORNER SHELF ASSEMBLY

BACKGROUND OF THE INVENTION

The present invention relates to storage solutions for shower enclosures, and more specifically to a corner shower shelf assembly that provides additional storage by leveraging the space around an existing corner shelf within a preexisting shower. Many contemporary showers are equipped with limited storage solutions, often restricted to small corner shelves that may not provide sufficient space for all necessary shower items, such as shampoos, soaps, razors, and other personal care products.

Various auxiliary shower storage devices have been developed to address this need, including suction-cup shelves, hanging caddies, and adjustable racks. However, these solutions often suffer from several limitations, such as instability, unsightly designs, or incompatibility with the existing layout of a shower. For example, suction-based shelves can lose adherence due to moisture exposure, and over-the-showerhead caddies may interfere with the functionality of the showerhead itself. Additionally, such devices rarely provide a stable, long-term storage solution that integrates seamlessly with preexisting shower fixtures.

One significant deficiency in shower storage devices is stability. For example, hanging racks are often suspended over the showerhead or attached to the wall using minimal support, making them prone to swaying or dislodging when items are added or removed. This instability not only creates a safety hazard, as heavy bottles or items may fall, but it also limits the user's confidence in storing heavier or breakable items on these caddies. Additionally, caddies that rely on tension poles between the floor and ceiling of the shower tend to become loose over time due to humidity and temperature changes, resulting in an unreliable storage solution.

Aesthetic incompatibility with modern shower designs is a frequent issue. Many shower caddies are designed as add-ons with limited attention to appearance, creating a cluttered or disorganized look in the shower area. They often stand out against modern minimalist shower fixtures, which can detract from the overall appearance of the shower. Users may seek a more integrated look that blends with existing fixtures rather than appearing as a bulky addition.

Current market solutions also tend to consume additional space within the shower, reducing the usable shower area and, in many cases, cluttering the corner area rather than optimizing it. There remains a need, therefore, for a shower storage solution that integrates effectively with an existing corner shelf, enhances the available storage capacity, and maintains a neat, aesthetically pleasing appearance within the shower environment.

Given these various deficiencies in known art shower storage solutions, there is a clear need for a shower storage device that addresses the issues of stability, space efficiency and aesthetic integration. The present invention, a corner shower shelf assembly that mounts directly over an existing integrated corner shelf, effectively overcomes these limitations by providing a stable, space-efficient, and visually cohesive solution designed specifically for the unique conditions of a shower environment.

In light of the devices disclosed in the known art, it is submitted that the present invention substantially diverges in design elements and methods from the known art and consequently it is clear that there is a need in the art for an improvement for a corner shelf assembly. In this regard the instant invention substantially fulfills these needs.

SUMMARY OF THE INVENTION

In view of the foregoing disadvantages inherent in the known types of corner shelf assemblies now present in the known art, the present invention provides a new corner shelf assembly wherein the same can be mounted over an integrated corner shelf of a preexisting shower.

It is an objective of the present invention to provide a corner shower shelf assembly comprising a bracket designed to mount directly over an existing corner shelf, enabling a stable installation that prevents slippage or instability even in high-moisture environments.

It is an objective of the present invention to provide a corner shower shelf assembly wherein the usability of the preexisting corner shelf is unincumbered by allowing a substantial portion of the corner shelf to remain exposed. The bracket comprises a pair of parallel bars forming a ninety-degree angle, wherein the bracket configuration allows the assembly to integrate with the existing shelf without obscuring it, thereby maximizing storage efficiency.

It is an objective of the present invention to provide a corner shower shelf assembly wherein the use of corner space within a shower enclosure is optimized by providing a bracket configured to fit snugly between two walls that form a ninety-degree angle. This configuration ensures that the invention occupies minimal space while maximizing storage in underutilized corner areas.

It is an objective of the present invention to provide a corner shower shelf assembly comprising one or more auxiliary shelves positioned above or below the main bracket to provide customizable storage options. These auxiliary shelves are designed to be adjustable in both height and size, allowing users to accommodate various items of different dimensions, such as bottles, razors, and other personal care products.

It is therefore an object of the present invention to provide a new and improved corner shelf assembly comprising that has all of the advantages of the known art and none of the disadvantages.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purpose of presenting a brief and clear description of the present invention, the preferred embodiment will be discussed as used for mounting a shower storage device over an integrated corner shelf of a preexisting shower. The figures are intended for representative purposes only and should not be considered to be limiting in any respect.

Reference will now be made in detail to the exemplary embodiment(s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment", "first embodiment", "second embodiment", or "third embodiment" does not necessarily refer to the same embodiment. Additionally, reference to an "device" can refer to a single guard member or more than one guard members.

As used herein, "right corner" is used interchangeably with a right angle or a 90-degree corner but is not limited to an exact 90-degree angle. Instead, "right corner" refers broadly to the intersection of two substantially perpendicular walls, surfaces, or planes forming an angle that approximates a right angle. For the purposes of this invention, "right corner" includes angles ranging from approximately 80 degrees to approximately 100 degrees, accounting for typical variances in alignment or construction while maintaining the functional characteristics of a right corner as described herein.

Figure 1:
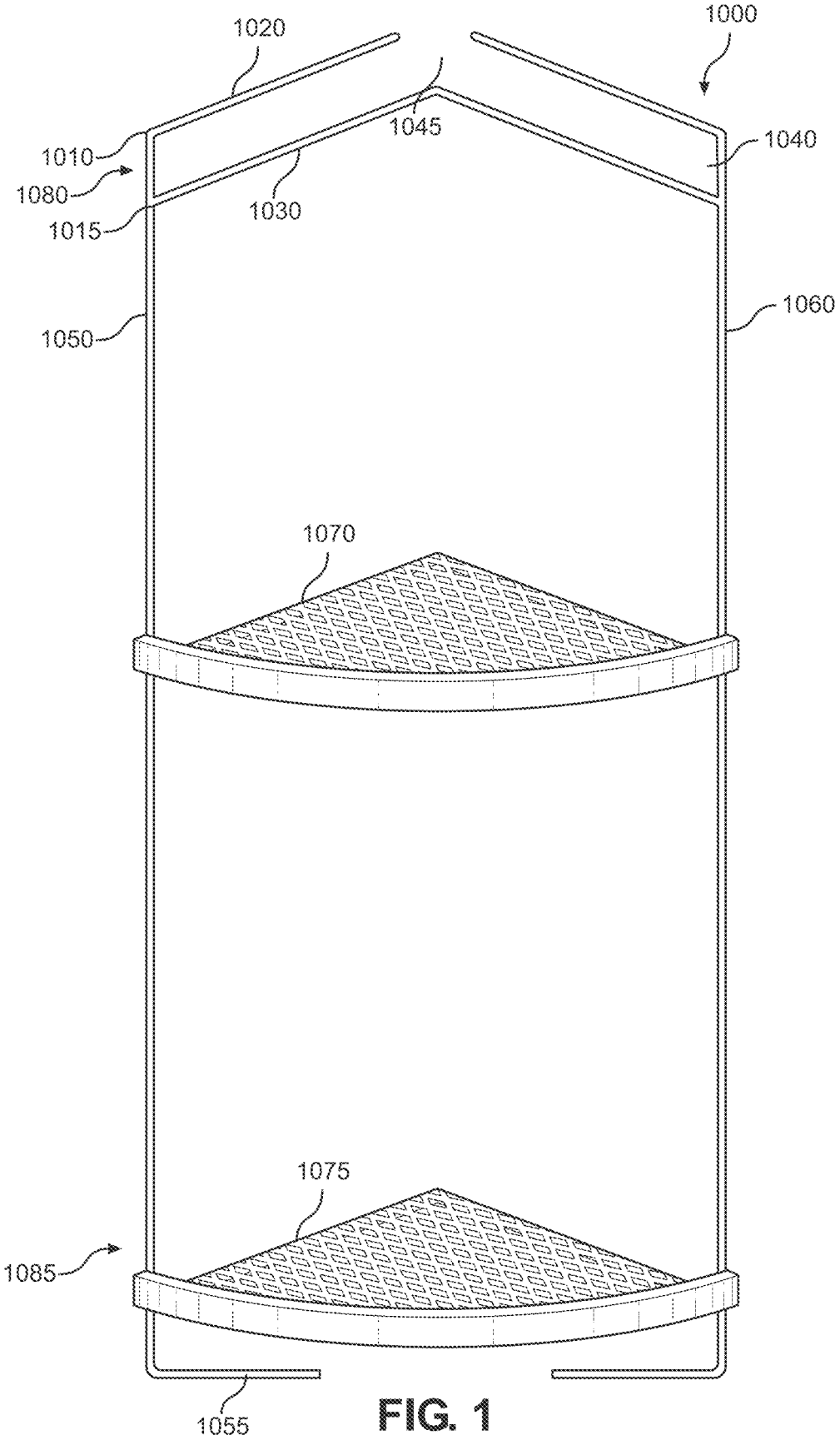
FIG. 1 shows a perspective view of an embodiment of the corner shelf assembly.
Figure 2:
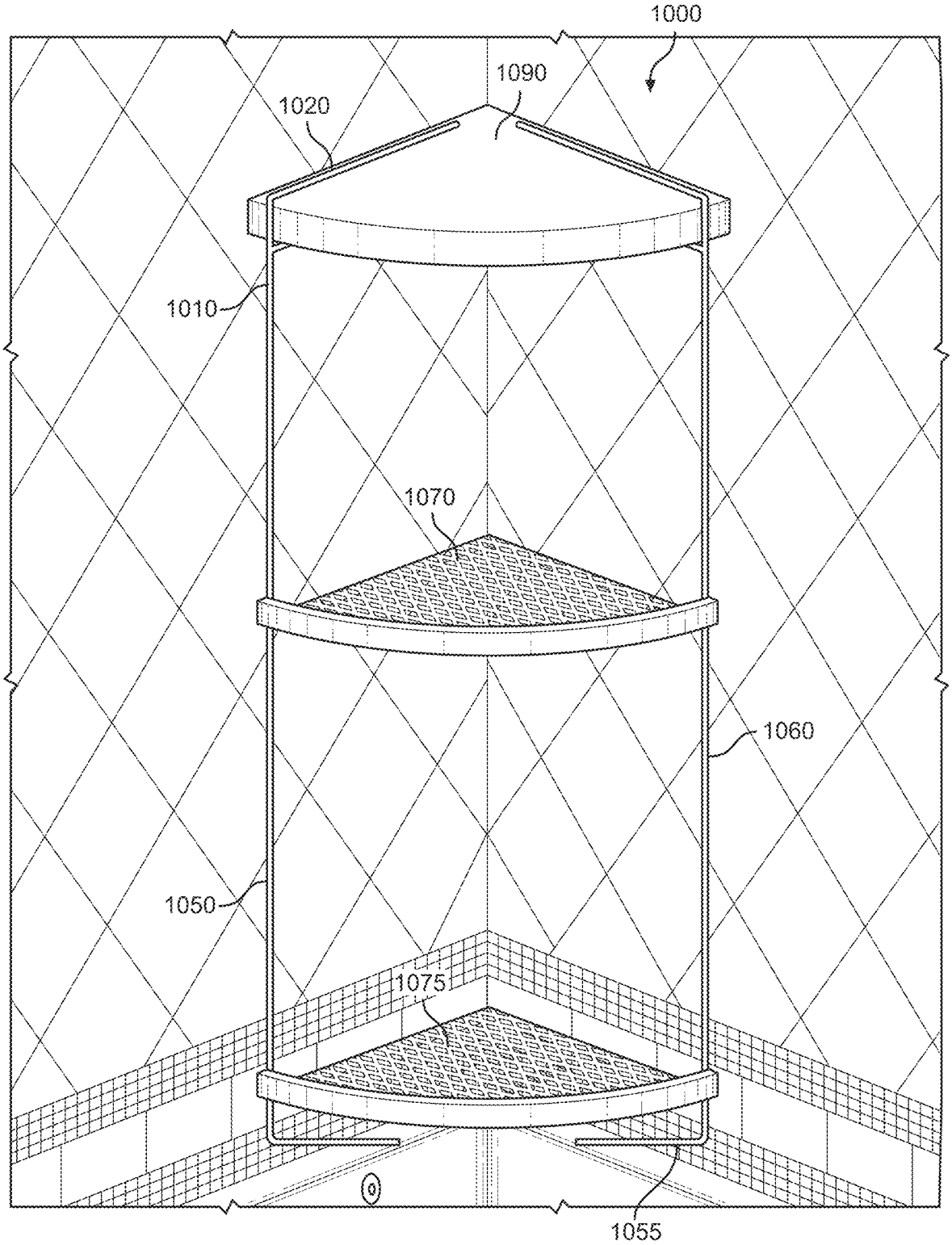
FIG. 2 shows a perspective view of an embodiment of the corner shelf assembly suspended from a corner shelf.

Referring now to FIGS. 1-2, there is shown a perspective view of an embodiment of the corner shelf assembly and a perspective view of an embodiment of the corner shelf assembly suspended from a corner shelf, respectively. The corner shelf assembly 1000 comprises a bracket 1010 configured to hang securely over a preexisting integrated corner shelf within a ninety-degree corner of the shower enclosure. The bracket 1010 comprises a first end 1080 and an opposing second end, wherein a pair of parallel bars 1020, 1030 dimensioned to receive a corner shelf 1090 are disposed at the first end. The parallel bars 1020, 1030 intersect at a ninety-degree angle to form a gap 1040. The gap 1040 is dimensioned to receive the integrated corner shelf, enabling the assembly 1000 to be suspended without requiring permanent attachment hardware, such as screws or adhesives. The parallel bars 1020, 1030 are designed to mount over the corner shelf, securing the entire structure against the shower walls. In the illustrated embodiment, a first parallel bar 1020 of the pair form a second gap 1045 at the midpoint thereof, wherein the second parallel bar 1030 does not include a break in the connection. In this way, the second gap 1045 provides more shelf area when the bracket 1010 is secured to the corner shelf. In alternate embodiments, the bracket does not include a second gap. In some embodiments, a pair of end caps are disposed around the distal ends of the first parallel bars 1020 to prevent slippage from the corner shelf or to add an additional thickness to the parallel bars to better fit around the corner shelf. The end caps comprise a channel to receive the distal ends and are composed of a flexible material, such as silicone or rubber.

The exterior ends 1015 of the parallel bars 1020, 1030 are secured together by a pair of crossbars 1050, 1060, which are positioned perpendicularly to the parallel bars 1020, 1030. In the illustrated embodiment, the crossbars 1050, 1060 extend downwards from the parallel bars when the bracket is secured to the corner shelf. However, in alternate embodiments, it is contemplated that the crossbars extend upwards therefrom. The crossbars 1050, 1060 connect the bracket 1010 to a secondary shelf 1070, which forms the second end of the corner shelf assembly 1000. The secondary shelf 1070 has a wedge-shaped structure that conforms to the ninety-degree angle of the corner, fitting snugly within the shower's corner while providing additional storage space.

In FIG. 2, the corner shower shelf assembly 1000 is shown in its suspended position over an integrated corner shelf 1090. When positioned in this manner, the gap 1040 of the bracket 1010 rests over the integrated shelf 1090, enabling the assembly to be securely held in place. This configuration allows the secondary shelf 1070 to extend below the integrated shelf 1090, creating a layered storage solution. The assembly's wedge shape enables it to fit tightly between the shower walls, ensuring a stable structure that maximizes the use of otherwise underutilized corner space. In the illustrated embodiment, a third shelf 1075 is suspended from the crossbars, beneath the secondary shelf 1070. In alternate embodiment, the assembly comprises only one shelf or, in other embodiments, more than two shelves.

In one embodiment, a pair of L-shaped bars 1055 extend from an end of each crossbar, 1050, 1060 at the second end 1085 of the bracket 1010. The L-shaped bars 1055 are configured to receive other shower items adapted to hook or otherwise suspend therefrom. In alternate embodiments, a pair of end caps are disposed around the distal ends of the L-shaped bars 1055 to help retain objects suspended therefrom from slipping. The end caps comprise a channel to receive the distal ends and are composed of a flexible material, such as silicone or rubber.

The corner shelf assembly 1000 is designed to maintain accessibility to the integrated corner shelf 1090 by exposing a substantial portion of it through the gap 1040. This design enables the user to utilize both the original corner shelf 1090 and the secondary shelf 1070, increasing overall storage capacity without sacrificing access to either level. The bracket 1010 and crossbars 1050 and 1060 provide structural stability, supporting the weight of various shower items placed on the secondary shelf 1070 and ensuring that the assembly remains secure even in humid and wet conditions typical of shower environments.

Figure 3:
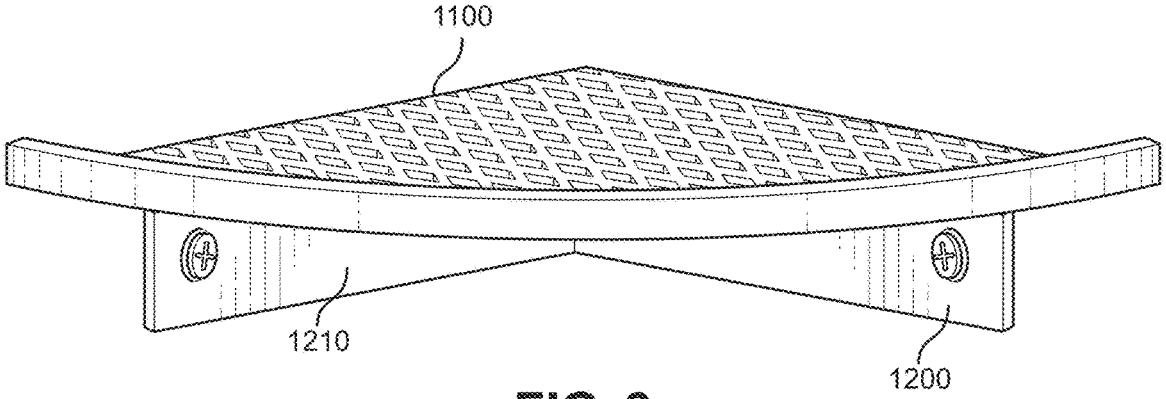
FIG. 3 shows a perspective view of an add-on corner shelf member of an embodiment of the corner shelf assembly.
Figure 4:
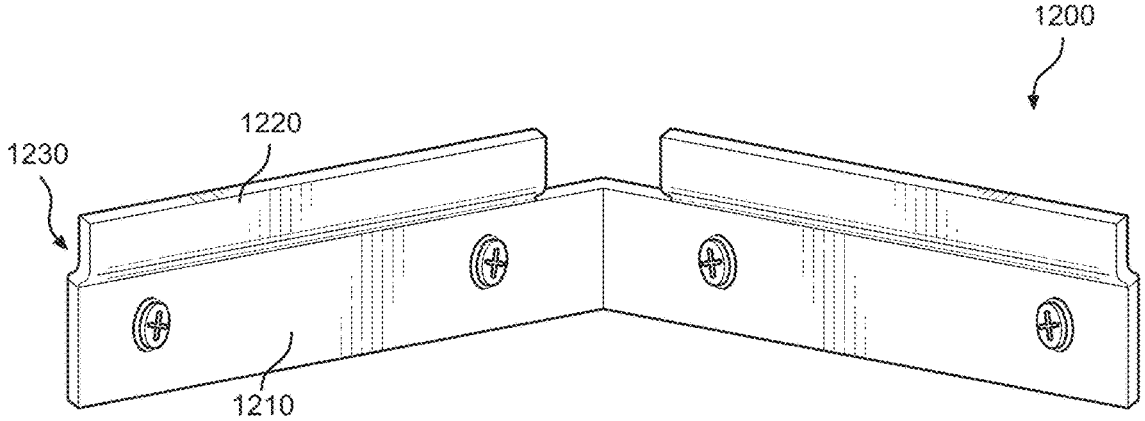
FIG. 4 shows a perspective view of a shelf bracket of an embodiment of the corner shelf assembly.
Figure 5:
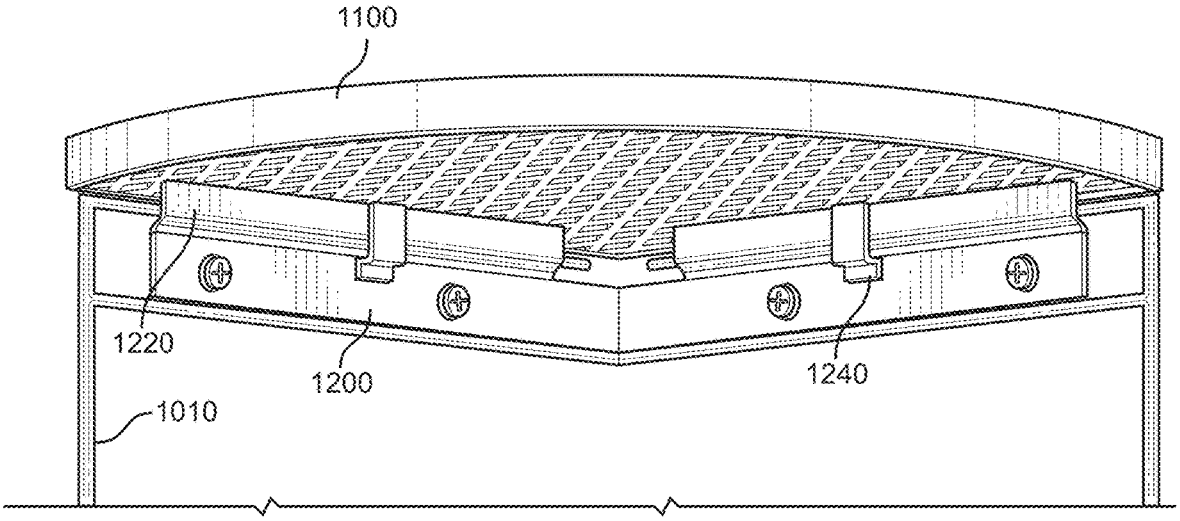
FIG. 5 shows a perspective view of the upper end of an embodiment of the corner shelf assembly.

Referring now to FIGS. 3-5, there is shown a perspective view of an add-on corner shelf member of an embodiment of the corner shelf assembly, a perspective view of a shelf bracket of an embodiment of the corner shelf assembly and a perspective view of the upper end of an embodiment of the corner shelf assembly, respectively. In the illustrated embodiment, the corner shelf assembly further comprises an add-on corner shelf member 1100. In this way, if an existing shower does not have a built-in corner shelf, one can be added. The add-on corner shelf 1100 is designed to align with the wedge shape of the primary structure, allowing it to fit neatly into the corner space of the shower.

The corner shelf assembly further comprises an L-shaped bracket 1200 having an L-shaped mounting member 1210 configured to mount to and rest flush against a vertical surface. The mounting member 1210 is adapted to fasten to the vertical surface via any suitable fastener, such as one or more screws. A pair of flanged members 1220 are perpendicular to one another and extend from an upper end of the mounting member 1210, wherein the pair of flanged members 1220 are offset from the mounting member such that a channel 1230 is formed between the vertical surface and the flanged members 1220 when the mounting member 1210 is secured to the vertical surface. The channel 1230 is configured to receive the add-on corner shelf 1100. One or more clips 1240 are configured to secured the add-on corner shelf

1100 to the L-shaped bracket 1200 once in place. In the illustrated embodiment, the clips 1240 are disposed on the lower side of the add-on corner shelf 1100. The bracket 1010 can then be placed over the add-on shelf member 1100 as described above.

In one embodiment, the corner shower shelf assembly is constructed from water-resistant and rust-resistant materials to ensure durability and longevity in the humid, high-moisture environment of a typical shower. Suitable materials for this purpose include stainless steel, anodized aluminum, and certain high-strength polymers such as ABS or polypropylene, for their corrosion resistance and structural integrity. Stainless steel, for example, offers excellent resistance to rust and is highly durable, providing a robust framework for the assembly that can withstand frequent water exposure without compromising strength or appearance. Anodized aluminum, another viable material, combines lightweight properties with a protective oxide layer that resists corrosion and maintains a sleek, non-rusting surface. In addition, advanced polymers like ABS and polypropylene can provide an economical, corrosion-resistant alternative that is resistant to mold, mildew, and degradation from water and cleaning agents. These materials not only extend the lifespan of the assembly but also contribute to a clean, low-maintenance storage solution that remains hygienic and visually cohesive in a shower setting.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, device and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A corner shelf assembly, comprising:

a unitary, rigid bracket configured to be supported by a preexisting corner shelf, the bracket comprising a first bar and a second bar;

wherein each of the first bar and the second bar comprises an upper member and a lower member extending parallel to one another;

wherein the lower member of the first bar is integrally connected to the lower member of the second bar at a perpendicular junction;

wherein a receiving gap is formed between the upper member and the lower member of each of the first bar and the second bar, the receiving gap being configured to receive the preexisting corner shelf;

a secondary shelf positioned below the receiving gap;

a pair of crossbars extending downward from and integrally formed with the first and second bars;

wherein the first bar, the second bar, and the crossbars form a monolithic frame wherein a load from the secondary shelf is configured to be transferred through the monolithic frame into the preexisting corner shelf.

2. The corner shelf assembly of claim 1, wherein the receiving gap exposes a usable portion of the preexisting corner shelf when the bracket is installed.

3. The corner shelf assembly of claim 1, wherein the first bar and the second bar are aligned parallel with the adjacent walls forming a corner.

4. The corner shelf assembly of claim 1, further comprising a third shelf configured to be positioned above or below the secondary shelf.

5. The corner shelf assembly of claim 1, wherein the secondary shelf is vertically spaced from the preexisting corner shelf to form a multi-level storage arrangement when the bracket is installed.

6. The corner shelf assembly of claim 1, wherein the secondary shelf and bracket are constructed of a corrosion-resistant material.

7. The corner shelf assembly of claim 1, wherein the bracket is supported on the preexisting corner shelf without the use of adhesives or fasteners.

8. The corner shelf assembly of claim 1, wherein the assembly is sized to fit into a ninety-degree corner formed by two adjacent walls.

9. The corner shelf assembly of claim 1, further comprising a pair of L-shaped bars extending from a lower end of the bracket and configured to suspend items therefrom.

10. The corner shelf assembly of claim 1, wherein the secondary shelf is selectively detachable from the assembly for flexible configuration.

11. The corner shelf assembly of claim 1, wherein the secondary shelf includes one or more drainage openings to prevent water accumulation.

12. The corner shelf assembly of claim 1, wherein the first and second bars are configured to rest on the preexisting corner shelf at laterally spaced locations when the bracket is installed.

13. The corner shelf assembly of claim 1, further comprising an add-on corner shelf member configured to mount to the adjacent walls.

14. The corner shelf assembly of claim 13, wherein the add-on corner shelf member is wedge-shaped to fit within the ninety-degree corner space formed by adjacent shower walls.

15. The corner shelf assembly of claim 13, further comprising an L-shaped bracket configured to mount the add-on corner shelf member to the adjacent walls.

16. The corner shelf assembly of claim 15, wherein the L-shaped bracket includes an L-shaped mounting member adapted to rest flush against the vertical surface and a pair of flanged members extending perpendicularly from an upper end of the L-shaped mounting member, the flanged members being offset from the mounting member to form a channel.

17. The corner shelf assembly of claim 1, wherein the secondary shelf comprises a corner-shaped support surface having two rear edges configured to extend along adjacent walls and a curved front edge extending between the pair of crossbars, the curved front edge forming a ledge that extends between the pair of crossbars.

* * * * *